US006190298B1

(12) United States Patent
Blumberg

(10) Patent No.: US 6,190,298 B1
(45) Date of Patent: Feb. 20, 2001

(54) MANUFACTURE OF FILE FOLDERS

(75) Inventor: Murray B. Blumberg, Gauteng (ZA)

(73) Assignee: Press Products (Proprietary) Limited, Johannesburg (ZA)

( * ) Notice: Under 35 U.S.C. 154(b), the term of this patent shall be extended for 0 days.

(21) Appl. No.: 09/299,326

(22) Filed: Apr. 26, 1999

Related U.S. Application Data

(63) Continuation-in-part of application No. 09/053,433, filed on Apr. 1, 1998, now abandoned.

(51) Int. Cl.[7] ..... B31B 1/14

(52) U.S. Cl. ..... 493/354; 493/355; 493/363; 493/372; 493/947; 402/14; 412/34

(58) Field of Search ..... 493/947, 347, 493/348, 346, 354, 363, 372, 385, 384, 381, 355, 403, 402, 401, 380, 345; 402/14, 15, 8; 412/36, 34, 43, 901; 227/27, 57

(56) References Cited

U.S. PATENT DOCUMENTS

| | | | | |
|---|---|---|---|---|
| 1,971,892 | | 8/1934 | Anderson et al. . | |
| 2,088,805 | | 8/1937 | Olm et al. . | |
| 2,138,788 | | 11/1938 | Hart et al. . | |
| 3,699,633 | | 10/1972 | Kidd . | |
| 3,741,385 | | 6/1973 | Corey . | |
| 3,865,017 | | 2/1975 | Borski . | |
| 3,867,743 | | 2/1975 | Corey . | |
| 4,130,933 | | 12/1978 | Demrick . | |
| 4,159,767 | * | 7/1979 | Jesme et al. | 206/343 |
| 4,175,476 | | 11/1979 | Kidd . | |
| 4,285,754 | | 8/1981 | DiMatteo . | |
| 4,373,986 | | 2/1983 | Cone . | |
| 4,684,433 | | 8/1987 | Gohr . | |
| 4,764,240 | | 8/1988 | Simeone, Sr. et al. . | |
| 4,766,656 | * | 8/1988 | Gutowski | 227/27 |
| 4,795,414 | | 1/1989 | Blumle . | |
| 4,950,097 | | 8/1990 | Blumberg . | |
| 5,007,758 | | 4/1991 | Blumberg . | |
| 5,011,318 | | 4/1991 | Gilmore . | |
| 5,098,366 | | 3/1992 | Gressman . | |
| 5,114,394 | | 5/1992 | Madsen . | |
| 5,125,885 | | 6/1992 | Wooley et al. . | |
| 5,248,290 | | 9/1993 | Hawes, Jr. et al. . | |
| 5,259,825 | | 11/1993 | DeAngelis et al. . | |
| 5,403,428 | | 4/1995 | Shingo et al. . | |
| 5,549,539 | | 8/1996 | Rautenberg . | |
| 5,641,234 | | 6/1997 | Blumberg . | |
| 5,667,322 | | 9/1997 | Mucznik . | |
| 5,803,889 | | 9/1998 | Littman . | |

OTHER PUBLICATIONS

Form PTO –436 A A File Folder Having Reinforcing Tape on One Side of the Folder Covering Fold Lines and Extending Beyond Edges of the Folder Being Folded onto the Other Side, Jun. 1998.*

* cited by examiner

*Primary Examiner*—Peter Vo
*Assistant Examiner*—Louis Huynh
(74) *Attorney, Agent, or Firm*—Wood, Herron & Evans, L.L.P.

(57) ABSTRACT

A method of manufacturing a file folder includes the steps of displacing a predetermined length of a flexible material in a feed direction and forming a pair of spaced apertures in the material. The method further includes the steps of inserting a prong of a binder through each aperture, the binder having an elongate central portion with a prong extending from each end of the central portion and securing the central portion of the binder to the material. The invention also relates to an apparatus for manufacturing a file folder.

19 Claims, 5 Drawing Sheets

MANUFACTURE OF FILE FOLDERS

FIELD OF THE INVENTION

This is a continuation-in-part of U.S. patent application Ser. No. 09/053,433, filed Apr. 1, 1998 now abandoned, and hereby incorporated by reference in its entirety.

THIS INVENTION relates to the manufacture of file folders. More particularly, this invention relates to a method of manufacturing a file folder and to an apparatus for manufacturing a file folder.

BROAD DESCRIPTION OF THE INVENTION

According to a first aspect of the invention, there is provided a method of manufacturing a file folder, the method including the steps of displacing a predetermined length of a flexible material in a feed direction;

forming a pair of spaced apertures in the material;

inserting a prong of a binder through each aperture, the binder having an elongate central portion with a prong extending from each end of the central portion; and securing the central portion of the binder to the material.

The method may further include supplying the flexible material from a roll of the flexible material; and parting the material to form sheets, so that each sheet has the predetermined length.

Alternatively, the method may include supplying pre-cut sheets of the material from a supply of sheets, each sheet having the predetermined length.

The apertures may be formed in the material along a line parallel to the feed direction.

The material may be punched to form the apertures.

A depression may be formed on a first side of the material, to extend it at least between the apertures, to accommodate the central portion of the binder. An adhesive may be applied in the depression prior to inserting the prongs of the binder through the apertures, for securing the central portion of the binder to the material.

The method may further include supplying the binder with its prongs extending substantially transversely to the central portion and inserting the prongs through the apertures from a first side of the material; and displacing the prongs relative to the central portion towards a second side of the material so that the prongs lie substantially flat against the second side of the material.

The binder may be secured in position by adhering a length of tape to a first side of the material along a line parallel to the feed direction, to cover the central portion of the binder. An adhesive may be applied to the length of tape prior to adhering it to the material.

The tape may be continually adhered to the first side of the material and parted so that a portion of the tape extends beyond an edge of either side of each length of material.

Each portion of tape may be folded about its associated cut edge and adhered to a second side of each length of material.

The method may further include scoring each length of material to form at least one fold line along a line parallel to the feed direction in a region of the material which is covered-by the tape.

According to a second aspect of the invention, there is provided an apparatus for manufacturing a file folder, the apparatus including a displacement means for displacing a predetermined length of a flexible material in a feed direction;

an aperture forming means for forming a pair of spaced apertures in the material;

an inserting means for inserting a prong of a binder through each aperture, the binder having an elongate central portion with a prong extending from each end of the central portion; and a securing means for securing the central portion of the binder to the material.

The apparatus may also include a supply means for supplying the flexible material from a roll of the flexible material; and a parting means for parting the material to form sheets, so that each sheet has the predetermined length.

The roll of the flexible material may be in the form of a roll of paper board.

Alternatively, the apparatus may include a supply means for supplying pre-cut sheets of the material from a supply of sheets, each sheet having the predetermined length.

The aperture forming means may be a punching device which includes a punching die which is displaceable towards and away from the material to punch the apertures in the material. The punching die may be configured so that when the punching die executes an operating stroke, at least a region between the apertures is embossed to define a depression.

The apparatus may further include an adhesive application means, located upstream of the inserting means, for applying adhesive in the depression, between the apertures.

The inserting means may include a magazine for carrying a plurality of the binders, the magazine being configured to feed a binder, with its prongs extending substantially transversely to the central portion, at predetermined intervals, which correspond with the rate at which each pair of apertures passes the magazine. The apparatus may further include a displacement means for displacing the prongs relative to the central portion towards a second side of the material so that the prongs lie substantially flat against the second side of the material.

The securing means may include a dispenser for dispensing tape, the dispenser being positioned relative to the material to dispense a length of tape on to a first side of the material so that the tape is adhered to the first side of the material and covers the central portion of the binder.

The dispenser may be positioned to dispense the tape continually on to a central region of the material to extend substantially parallel to the feed direction. The dispenser may include an adhesive applicator for applying adhesive to the tape prior to the tape being adhered to the material.

The dispenser may further include a roll of the tape and an application means for applying the tape from the roll on to the side of the material.

In one embodiment of the invention, the parting means may be in the form of a first cutter which is positioned upstream of the dispenser, to cut the material into the required lengths prior to the tape being applied to the material. A separating means which may be positioned downstream of the first cutter to separate the lengths of material so that the lengths of material are spaced a predetermined distance apart. The apparatus may further include a second cutter which is positioned downstream of the dispenser to cut the tape so that a portion of the tape extends beyond each cut edge of the lengths of material.

In another embodiment of the invention, the apparatus may include a cutter which is positioned downstream of the dispenser to cut the tape so that a portion of the tape extends beyond each cut edge of the lengths of material.

The apparatus may then include a folding device for folding each portion of the tape over its associated edge and applying each portion to an opposed side of the material.

The apparatus may also include a fold line forming means for scoring each length of material to form at least one fold line along a line parallel to the feed direction in a region of the material which is covered by the tape.

The invention is now described, by way of examples, with reference to the accompanying drawings.

DETAILED DESCRIPTION OF THE DRAWINGS

Figure 1:
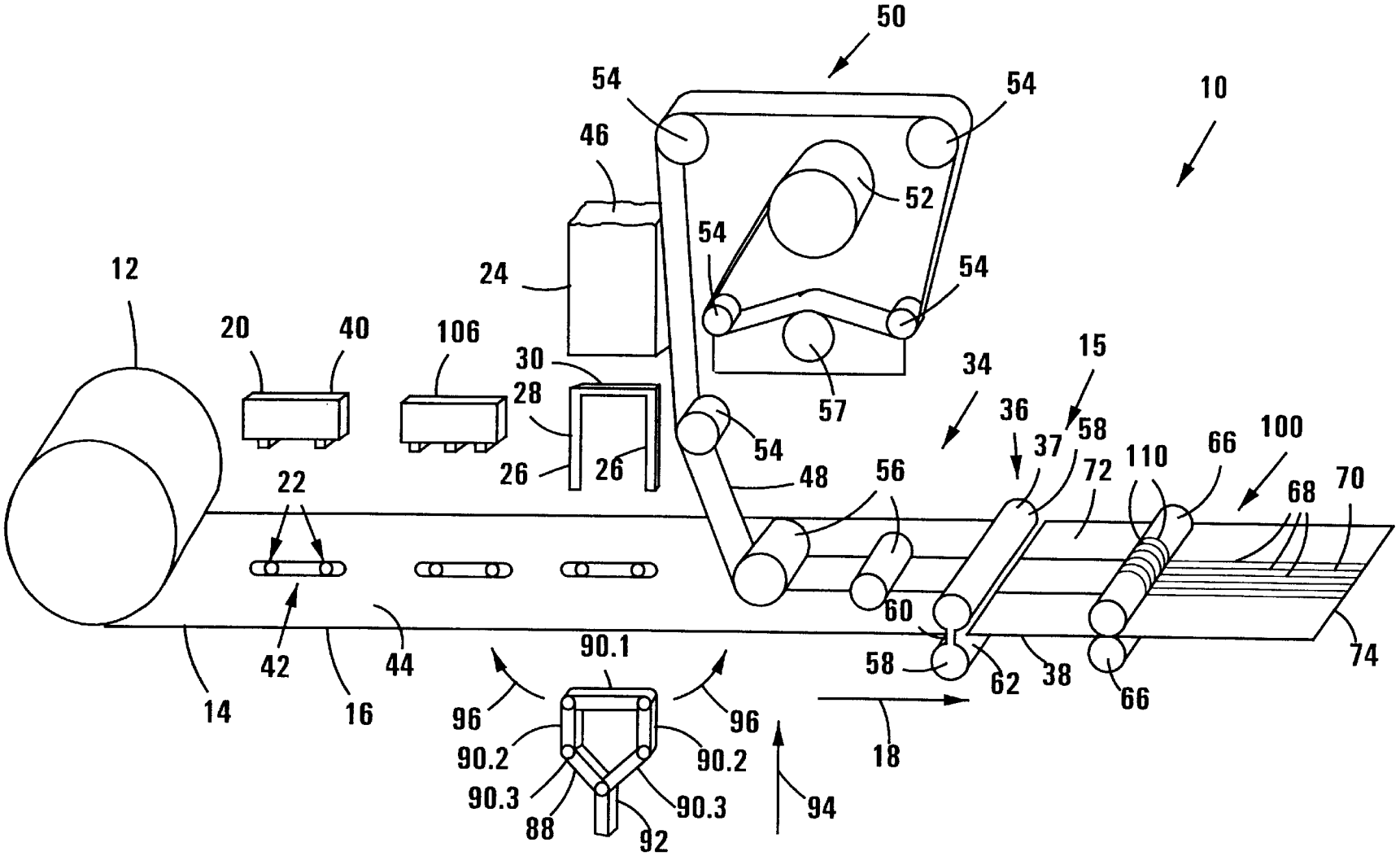
FIG. 1 shows a three-dimensional, schematic view of a first embodiment of an apparatus, in accordance with the invention, for manufacturing a file folder.

In FIG. 1, reference numeral 10 generally indicates a first embodiment of an apparatus, in accordance with the invention, for manufacturing a file folder.

The apparatus 10 includes a supply means in the form of a roll 12 of paper board 14. The roll 12 supplies a sheet 16 of the paper board 14. The apparatus 10 includes a displacement means in the form of roller sets 15. The roller sets 15 displace the sheet 16 in a feed direction indicated by an arrow 18.

The apparatus 10 includes an aperture forming means 20 for forming a pair of spaced apertures 22 in the sheet 16. An inserting means 24 inserts a prong 26 of a binder 28 through each aperture 22. Each binder 28 has an elongate central portion 30. One prong 26 extends from each end of the central portion 30. The central portion 30 is thus positioned on the sheet 16.

A securing means 34 secures the central portion 30 to the sheet 16. A parting means 36 parts the sheet 16 to provide required lengths 38. Each length 38 has a binder 28 secured thereto. The aperture forming means 20, the inserting means 24, the securing means 34 and the parting means 36 are at different stations. The inserting means 24 is downstream of the aperture forming means 20. The parting means 36 is located downstream of the securing means 34.

The apertures 22 are formed by punching. The aperture forming means 20 includes a punching die 40. The die 40 is displaceable towards and away from the sheet 16. The die 40 punches the apertures 22 in the sheet 16.

A depression 42 is formed in the sheet 16 between the apertures 22. The depression 42 accommodates the central portion 30. The die 40 is configured to emboss a region between the apertures 22 to define the depression 42. The die 40 is also configured so that the central portion 30 of the binder 28 is flush with an upper side 44 of the sheet 16.

The apparatus 10 includes an adhesive application means in the form of an applicator 106. The applicator 106 applies an adhesive to the upper side 44, in the depression 42. Thus, the central portion 30 is adhered to the upper side 44.

The inserting means 24 includes a magazine 46. A plurality of the binders 28 are loaded into the magazine 46. The magazine 46 feeds a binder 28 at predetermined intervals. The intervals correspond with the rate at which each pair of apertures 22 passes the magazine 46. A binder 28 is released from the magazine 46 when each pair of apertures 22 coincides with the magazine 46. The prongs 26 of the binder 28 then move through the apertures 22.

Once the prongs 26 of the binder 28 are moved through the apertures 22 and the central portion 30 is positioned in the depression 42, the prongs 26 are bent outwardly to lie against a lower side of the sheet 48.

Figure 5:
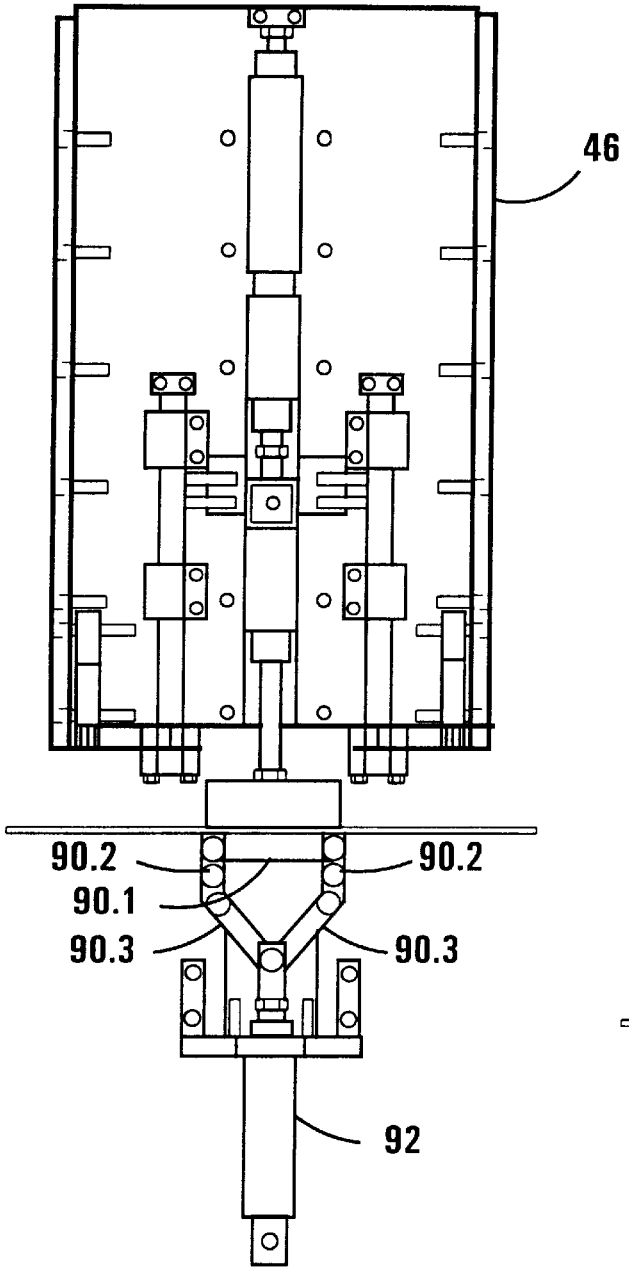
FIG. 5 shows a side view of a device for bending prongs of a binder in a first stage of operation.
Figure 6:
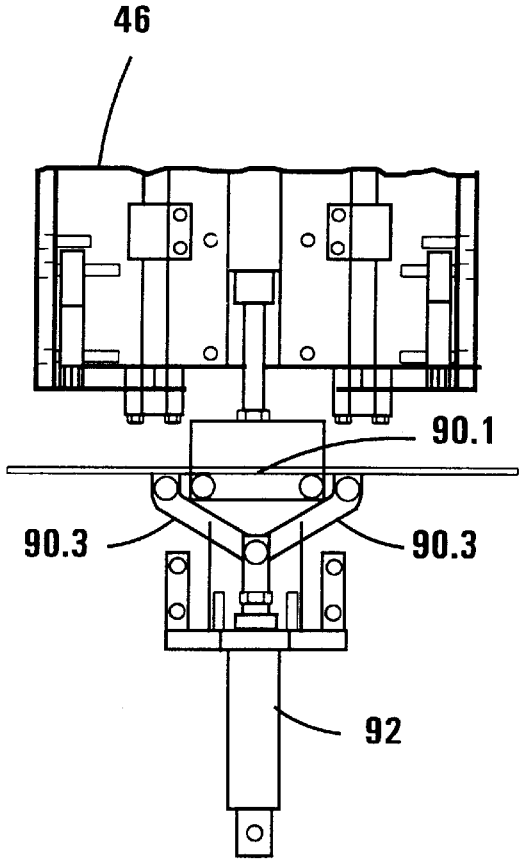
FIG. 6 shows a side view of the device of FIG. 5 in a second stage of operation.

The prongs 26 are bent outwardly by means of a device 88 which includes a number of link bars 90 which are pivotally connected to each other at their ends. A first stage of operation of the device 88 is shown in FIG. 5 and a second stage of operation of the device 88 is shown in FIG. 6. The link bars 90 comprise a primary link bar 90.1, a pair of secondary link bars 90.2 and a pair of tertiary link bars 90.3. An end of a secondary link bar 90.2 is pivotally connected to each end of the primary link bar 90.1. An opposed end of a secondary link 90.2 is pivotally connected to an end of each tertiary link bar 90.3. Opposed ends of the tertiary link bars 90.3 are pivotally connected together. A push rod 92 is pivotally connected to each said opposed end of the tertiary link bars 90.3.

It will be appreciated that, as the push rod 92 moves in the direction of an arrow 94, with the primary link bar bearing against the lower side of the sheet 16 (FIG. 5), the secondary link bars 90.2 pivot outwardly in the direction of arrows 96 (FIG. 6). The primary link bar 90.1 is dimensioned to be received snugly between the prongs 26, prior to the prongs 26 being bent. It follows that, once the prongs 26 have been received through the apertures 22, the device 88 is driven upwardly so that the primary link bar 90.1 is received between the prongs 26 and the portion of the sheet 16 between the apertures 22 is sandwiched between the central portion 30 and the primary link bar 90.1 (FIG. 5). The push rod 92 is then urged upwardly so that the secondary link bars 90.2 bend the prongs 26 into a position in which they are adjacent the lower side of the sheet 16 (FIG. 6).

The binder 28 is secured in position by adhering a length of tape 48 to the sheet 16. The tape 48 is adhered over the central portion 30. The securing means 34 thus includes a dispenser 50 for dispensing the tape 48. The dispenser 50 includes a roll 52 of the tape 48. A number of tensioning rollers 54 are positioned downstream of the roll 52. A pair of sets of applying rollers 56 are positioned downstream of the tensioning rollers 54. The sets of applying rollers 56 form part of the roller sets 15.

The tape 48 is fed from the roll 52 over the tensioning rollers 54. The tape 48 is applied to the sheet 16 by the applying rollers 56. The dispenser 50 also includes an adhesive application roller 57. The adhesive roller 57 applies adhesive to the tape 48.

The adhesive applicator 106 and the dispenser 50 can be operated individually, one without the other, or together, depending on a user's requirements.

The apertures 22 are punched on a line positioned parallel to the direction of feed. The apertures 22 are also punched centrally on the sheet 16. The applying rollers 56 are positioned to draw the sheet 16 along said line.

The parting means 36 is a cutter 37. The cutter 37 comprises a pair of cutting rollers 58. The cutting rollers 58 are positioned downstream of the applying rollers 56. The cutting rollers 58 form part of the roller sets 15. The cutting rollers 58 facilitate displacement of the sheet 16 in the direction of the arrow 18.

One of the cutting rollers 58 defines a blade 60. The other cutting roller 58 defines a bearing surface 62. The tape 48 is adhered to the sheet 16. The sheet 16 and the tape 48 pass between the blade 60 and the bearing surface 62. The cutting rollers 58 are configured to part the sheet 16 into the required lengths 38.

The apparatus 10 includes a fold line forming means 100. The fold line forming means 100 is positioned downstream of the parting means 36. The fold line forming means 100 includes a pair of impression rollers 66. The impression rollers 66 form a fold line and parallel ridges 68 in the tape 48. The fold line and parallel ridges 68 are also formed in that portion of the sheet 16 covered by the tape 48. The fold line forming means 100 can also be positioned upstream of the parting means 36. The impression rollers 66 have a number of ridges and grooves 110 defined thereon to form the fold line and parallel ridges 68.

The tape 48 is in the form of a reinforcing strip 70. Folders formed with the apparatus 10 have the reinforcing strip 70 extending from one cut edge 72 to an opposed cut edge 74.

Figure 2:
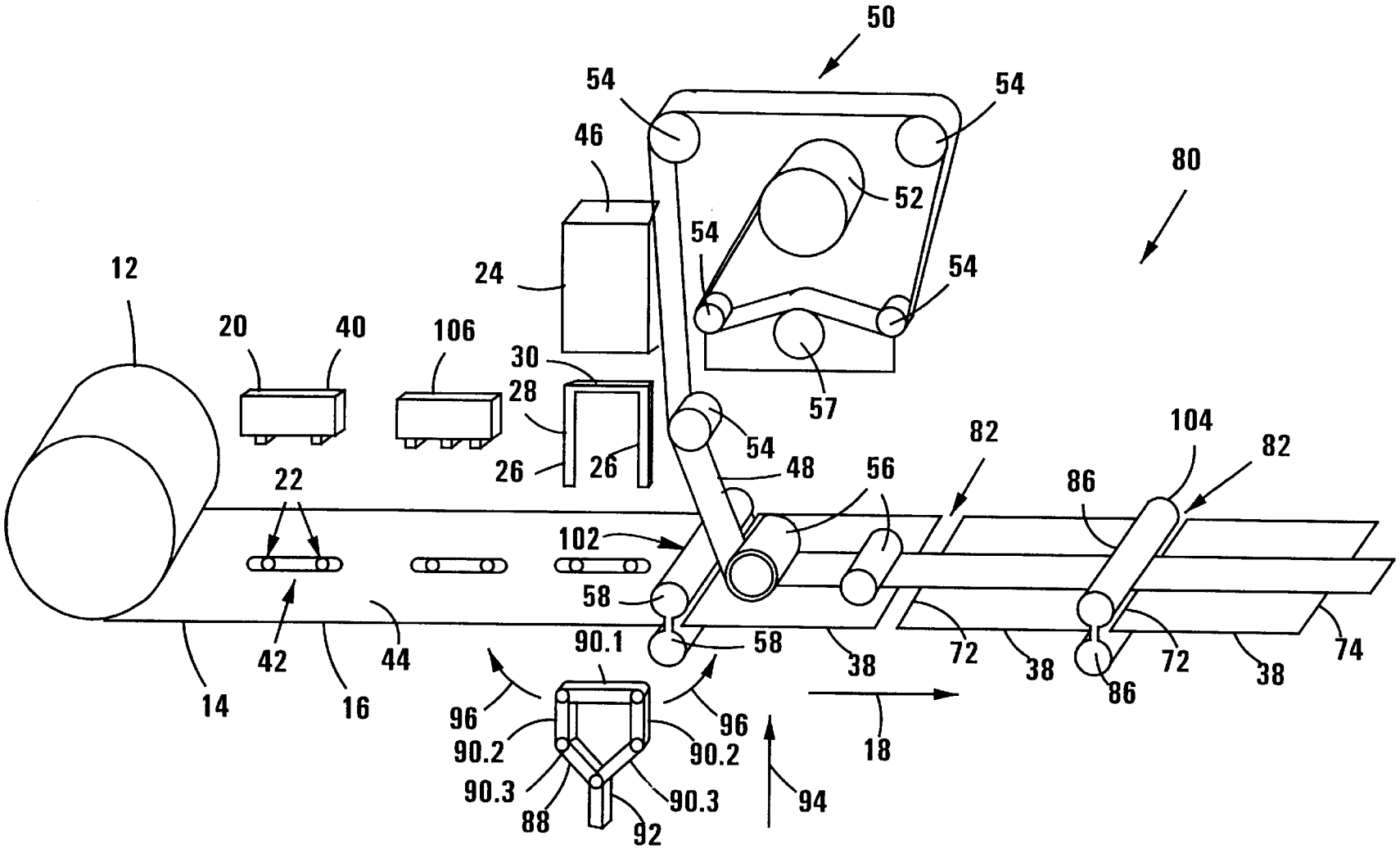
FIG. 2 shows a three-dimensional, schematic view of a second embodiment of the apparatus.

In FIG. 2, reference numeral 80 generally indicates a second embodiment of an apparatus, in accordance with the invention, for manufacturing file folders. With reference to FIG. 1, like reference numerals refer to like parts, unless otherwise specified.

In the apparatus 80, the parting means 36 includes a first cutter 102. The first cutter 102 is positioned upstream of the applying rollers 56. The cutting rollers 58 of the first cutter 102 part the sheet 14 into the required lengths 38. Relative speeds of the cutting rollers 58 and the applying rollers 56 define a separating means. The relative speeds result in the lengths 38 being separated once the sheet 16 is cut. A predetermined gap 82 is created between consecutive lengths 38. The tape 48 extends across each gap 82 downstream of the rollers 56.

A second cutter 104 comprises a further pair of cutting rollers 86. The cutting rollers 86 are positioned downstream of the applying rollers 56. The cutting rollers 86 part the tape 48 midway between the edges 72, 74 of consecutive lengths 38. Thus, a portion of tape 48 extends beyond each edge 72, 74 of the lengths 38.

The portions of the tape 48 are folded down in a manner described with reference to FIG. 3, below.

Figure 3:
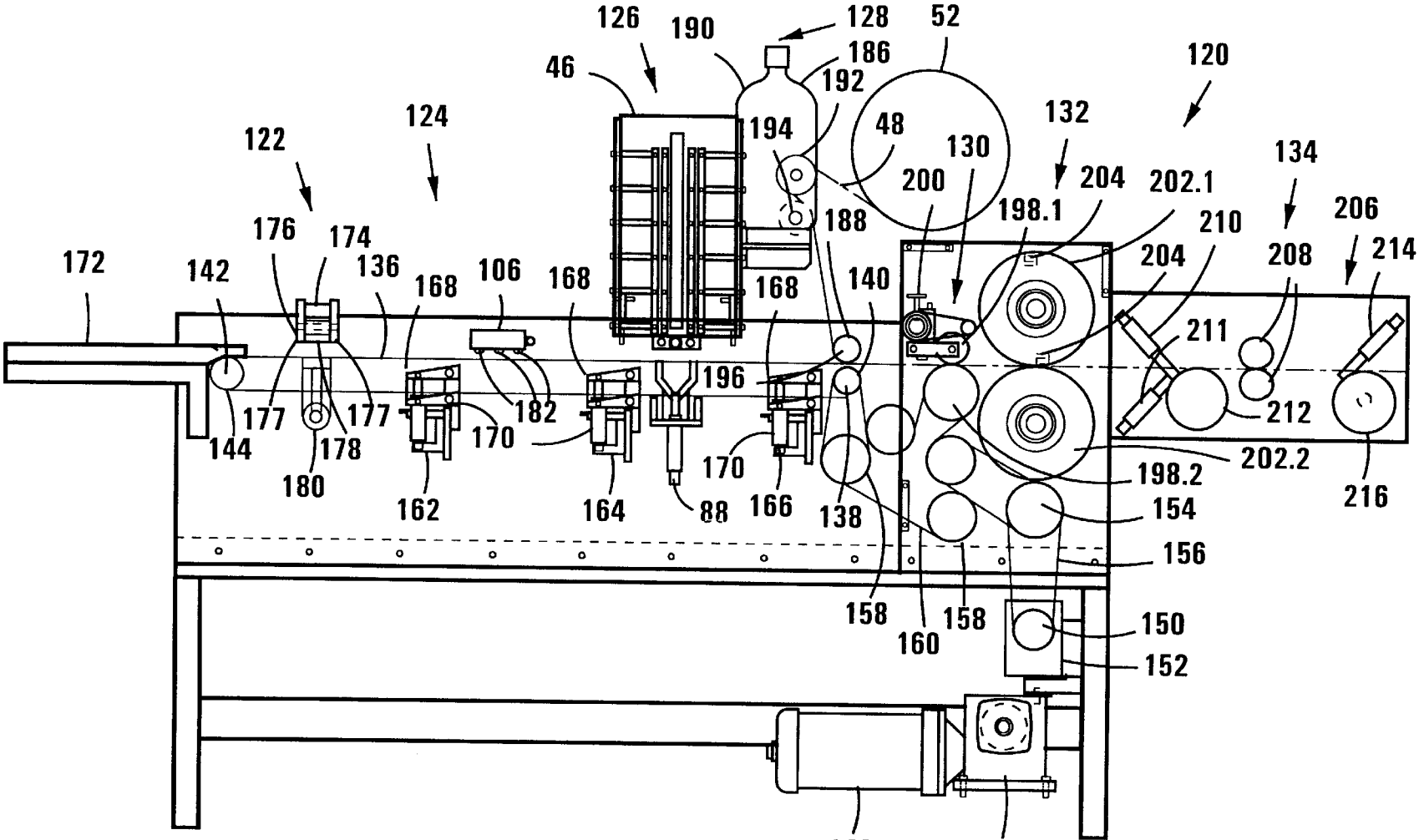
FIG. 3 shows a schematic side view of a third embodiment of the apparatus.

In FIG. 3, reference numeral 120 generally indicates a third embodiment of an apparatus, in accordance with the invention, for manufacturing file folders. With reference to FIGS. 1 and 2, like reference numerals refer to like parts, unless otherwise specified.

The apparatus 120 is designed to form file folders from discreet sheets of paper board, rather than from a roll of paper board.

With the apparatus 120, the sheets are punched and embossed at a first station 122. The adhesive is applied in the depression 42 at a second station 124, downstream of the first station 122. The binders 28 are fed from the magazine 46 and the prongs 26 are bent outwardly by the device 88 at a third station 126, downstream of the second station 124. The application of adhesive to the reinforcing strip 70 and the attachment of the reinforcing strip 72 to each sheet occurs at a fourth station 128, downstream of the third station 126. The fold line and parallel ridges 68 are applied to the reinforcing strip 28 and the corresponding portion of each sheet at a fifth station 130, downstream of the fourth station 128. The reinforcing strip 70 is cut at a sixth station 132. Those portions of the tape 48 extending beyond the edges 72, 74 of each sheet are folded over at a seventh station 134.

The apparatus 120 includes a conveyor belt assembly 136. A drive roller 138 is positioned at one end 140 of the assembly 136 while an idler roller 142 is positioned at an opposed end 144 of the assembly 136 in a conventional fashion.

The apparatus 120 includes a drive motor 146. The drive motor 146 is connected to a gear box 148 which, in turn, is connected to a drive pulley 150 via a clutch 152.

The drive pulley 150 is connected to a primary pulley 154 via a belt 156. The drive roller 138 is driven by the primary pulley 154 via a set of idler pulleys 158 and suitably positioned belts 160.

The first to fourth stations 122 to 128, inclusive, are positioned along the assembly 136. A first stop gate 162 is positioned between the first and second stations 122, 124. A second stop gate 164 is positioned between the second and third stations 124, 126. A third stop gate 166 is positioned between the third and fourth stations 126, 128. Each stop gate 162 to 166 includes a stop bar 168. The stop bar 168 is connected to an upwardly and downwardly reciprocating mechanism 170. The mechanisms 170 are configured to displace the stop bars 168 into operative positions in which the stop bars 168 retain the sheets in a stationary position during operation of the stations.

The apparatus 120 includes an infeed tray 172 from which the sheets are fed, by the assembly 136, towards the stations 122 to 134.

A punch and die arrangement 174 is positioned at the first station 122. The punch and die arrangement 174 includes a punch 176. The punch 176 has a pair of punch members 176 positioned on each side of an embossing formation 178. A die 180 of the punch and die arrangement 174 is positioned below the punch members 176.

During operation, once the stop bar 168 of the first stop gate 162 is displaced into its operative position so that a sheet is held stationary, the punch members 176 are displaced towards the die 180 so that the apertures 22 are punched in the sheet and the depression 42 is formed between the apertures 22.

The adhesive applicator 106 is positioned at the second station 124. The applicator 106 includes adhesive application nozzles 182. Once the stop bar 168 of the second stop gate 164 has moved into its operative position to retain a sheet in a stationary position, the applicator 106 is actuated so that adhesive is applied to the sheet via the nozzles 182. The second stop gate 164 and the nozzles 182 are positioned so that the adhesive is applied to the sheet in the depression 42.

The magazine 46 and the device 88 are positioned at the third station 126. As before, once the stop bar 128 of the third stop gate 166 is moved into its operative position, a binder 28 is fed from the magazine 46. The third stop gate 166, the magazine 46 and the device 88 are positioned so that, once the sheet is held stationary, the prongs 26 of the binder 28 can be fed through the apertures 22 and the device 88 operated, as described earlier, to bend the prongs 26 (FIGS. 5 and 6). A reciprocating mechanism (not shown) is provided which acts on the pusher rod 92 to operate the device 88.

The roll of tape 52, a tape wetting arrangement 186 and a tape applying roller 188 are all positioned at the fourth station 128. The tape wetting arrangement includes a supply 190 of adhesive. The arrangement 186 further includes a tensioning roller 192 and an adhesive application roller 194. The tape 48 is fed from the roll 52 over the tensioning roller 192 and then the adhesive application roller 194 so that adhesive is applied to the tape 48. A tape compression roller 196 is positioned directly above the drive roller 138 of the assembly 136. The tape compression roller is positioned so that the tape 48 is fed beneath the roller 196 and sufficient pressure is exerted on the tape 48 to obtain adhesion of the tape 48 on to the sheets as the sheets pass between the conveyor and the tape compression roller 196.

A pair of embossing rollers 198 is positioned at the fifth station 130. The rollers 198 are positioned so that the tape, with the sheets adhered thereto, is received between the rollers 198. A tensioning device 200 is mounted on an upper embossing roller 198.1 so that the pressure exerted by the rollers 198 on the tape 48 can be adjusted. The upper roller 198.1 is configured so that as the tape 48 and the sheets pass through the rollers 198, the fold line and parallel ridges 68 are formed in the tape 48 and the sheets. A lower embossing roller 198.2 is connected to the set of idler pulleys 158 so that the tape 48 and the sheets are driven through the embossing rollers 198.

A pair of cut off rollers 202 is positioned at the sixth station 132. An upper cut off roller 202.1 has a pair of cutting blades 204 mounted therein, in diametrically opposed positions. A lower cut off roller 202.2 is configured to define a cutting surface for the cutting blades 204. The upper cut off roller 202.1 is of a diameter which is such that the tape 48 is cut at a position intermediate adjacent ends of consecutive sheets.

The lower cut off roller 202.2 is drivingly connected to the primary pulley 154 so that the rollers 202 are rotated in suitable directions.

It will be appreciated that, once the tape has been cut, there will be provided lengths of tape 48 adhered to each sheet with portions of the tape extending past edges of each sheet. At the seventh station 134, these portions are folded over opposed edges of the sheets to adhere against a lower side of each sheet.

A device for folding said portions over is referred to with reference numeral 206. The device 206 includes a pair of opposed drive rollers 208 which serve to draw each length of tape and its associated sheet through the device 206.

A first upper ram 210 is provided to urge a rear overhanging portion of the tape 48 downwardly. A lower ram 211 and a first application roller 212 are provided upstream of the drive rollers 208 to urge the rear overhanging portion against the lower side of the sheet. A second upper ram 214 and a second application roller 216 are positioned downstream of the drive rollers 208 to urge a front overhanging portion of the tape 48 downwardly and then inwardly and upwardly to bear against the lower side of the sheet.

Figure 4:
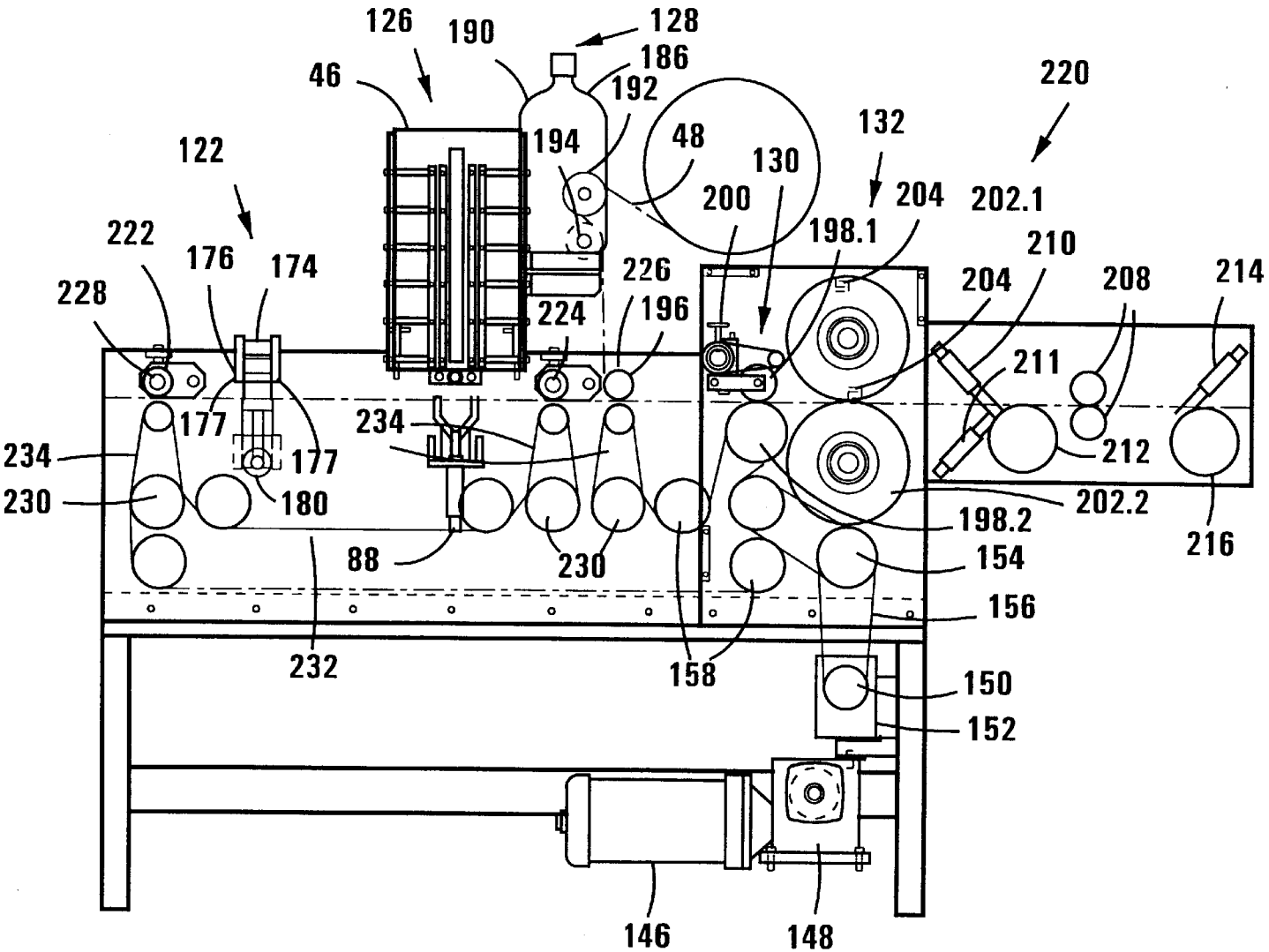
FIG. 4 shows a schematic side view of a fourth embodiment of the apparatus.

In FIG. 4, reference numeral 220 generally indicates a fourth embodiment of an apparatus, in accordance with the invention, for manufacturing file folders. With reference to FIGS. 1 to 3, like reference numerals refer to like parts, unless otherwise specified.

The apparatus 220 does not include the conveyor belt assembly 136. Instead, the apparatus 220 includes a first set of driving rollers 222, and second set of driving rollers 224 and a third set of driving rollers 226. The first set of driving rollers 222 includes a sheet infeed mechanism 228 so that the sheets can be fed directly to the first station 122.

The drive rollers 222 to 226 are driven by the motor 146 via the drive pulley 150, the set of idler pulleys 158 and a series of consecutively arranged, subsidiary drive pulleys 230. The subsidiary drive pulleys 230 are connected together via a belt 232. A subsidiary drive pulley 230 is connected to each set of drive rollers 222 to 226, via a belt 234.

The apparatus 220 does not include the adhesive applicator 106. Instead, the device 88 is relied upon to secure the binder 28 to the sheet.

The second set of drive rollers 224 is positioned downstream of the magazine 46 and the device 88.

The third set of drive rollers 226 is positioned at the fourth station 128. An upper roller of the third set 226 is the tape compression roller 196.

The apparatus 220 does not include the stop gates 170. Instead, the apparatus 220 relies on control of the drive rollers 222 to 226 to determine the position of the sheets at the stations 122, 126 and 128.

The Applicant believes that the invention provides a method and apparatus for manufacturing file folders in a substantially quicker and more cost effective manner than is presently possible with existing equipment.

What is claimed is:

1. An apparatus for manufacturing a file folder, the apparatus comprising:

a displacement means for displacing a predetermined length of a flexible material lengthwise in a feed direction, said flexible material having a first side and a second side;

an aperture forming means for forming a pair of spaced apertures in the material, the aperture forming means being a punching device which includes a punching die which is displaceable towards and away from the material to punch the apertures in the material, with the punching die being configured so that when the punching die executes an operating stroke, at least a region between the apertures is embossed to define a depression;

an inserting means for inserting a prong of a binder through each aperture from the first side of the material, the binder having an elongate central portion with a prong extending from each end of the central portion; and a securing means for securing the central portion of the binder to the first side of the material.

2. The apparatus as claimed in claim 1, which includes a supply means for supplying the flexible material from a roll of the flexible material; and a parting means for parting the material to form sheets, so that each sheet has the predetermined length.

3. The apparatus as claimed in claim 1, which includes a supply means for supplying pre-cut sheets of the material from a supply of sheets, each sheet having the predetermined length.

4. The apparatus as claimed in claim 1, which includes an adhesive application means, located upstream of the inserting means, for applying adhesive in the depression, between the apertures.

5. An apparatus for manufacturing a file folder, the apparatus comprising:

a displacement means for displacing a predetermined length of a flexible material lengthwise in a feed direction, said flexible material having a first side and a second side;

an aperture forming means for forming a pair of spaced apertures in the material;

an inserting means for inserting a prong of a binder through each aperture from the first side of the material, the binder having an elongate central portion with a prong extending from each end of the central portion, the inserting means includes a magazine for carrying a plurality of the binders, the magazine being configured to feed a binder, with its prongs extending substantially transversely to the central portion, at predetermined intervals, which correspond with a rate at which each pair of apertures passes the magazine; and a securing means for securing the central portion of the binder to the first side of the material.

6. The apparatus as claimed in claim 5, which includes a displacement means for displacing the prongs relative to the central portion towards the second side of the material so that the prongs lie substantially flat against the second side of the material.

7. An apparatus for manufacturing a file folder, the apparatus comprising:

a displacement means for displacing a predetermined length of a flexible material lengthwise in a feed direction, said flexible material having a first side and a second side;

an aperture forming means for forming a pair of spaced apertures in the material;

an inserting means for inserting a prong of a binder through each aperture from the first side of the material, the binder having an elongate central portion with a prong extending from each end of the central portion;

a securing means for securing the central portion of the binder to the first side of the material, the securing means including a dispenser for dispensing tape, the dispenser being positioned to dispense a length of tape on to the first side of the material so that the tape is adhered to the first side of the material and covers the central portion of the binder;

a supply means for supplying the flexible material from a roll of the flexible material; and a parting means for parting the material to form sheets, so that each sheet has the predetermined length.

8. The apparatus as claimed in claim 7, in which the dispenser is positioned to dispense the tape continually on to a central region of the material to extend substantially parallel to the feed direction.

9. The apparatus as claimed in claim 7, in which the dispenser includes an adhesive applicator for applying adhesive to the tape prior to the tape being adhered to the material.

10. The apparatus as claimed in claim 7, in which the dispenser includes a roll of tape, and the apparatus including an application means for applying tape from the roll on to the material.

11. The apparatus as claimed in claim 10, in which the application means includes at least one roller which is positioned to bear against the material so that tape from the roll is pressed on to the material while the material is fed.

12. The apparatus as claimed in claim 7, in which the parting means is in the form of a first cutter to cut the material into the required lengths prior to the tape being applied to the material.

13. The apparatus as claimed in claim 12, which includes a separating means to separate the lengths of material so that the lengths of material are spaced a predetermined distance apart.

14. The apparatus as claimed in claim 13, which includes a second cutter which is positioned downstream of the dispenser to cut the tape so that a portion of the tape extends beyond each cut edge of the lengths of material.

15. The apparatus as claimed in claim 14, which includes a folding device for folding each portion of the tape over its associated edge and applying each portion to an opposed side of the material.

16. The apparatus as claimed in claim 7, which includes a fold line forming means for scoring each length of material to form at least one fold line along a line parallel to the feed direction in a region of the material which is covered by the tape.

17. An apparatus for manufacturing a file folder, the apparatus comprising:

a displacement means for displacing a predetermined length of a flexible material lengthwise in a feed direction, said flexible material having a first side and a second side;

an aperture forming means for forming a pair of spaced apertures in the material;

an inserting means for inserting a prong of a binder through each aperture from the first side of the material, the binder having an elongate central portion with a prong extending from each end of the central portion;

a securing means for securing the central portion of the binder to the first side of the material, the securing means including a dispenser for dispensing tape, the dispenser being positioned to dispense a length of tape on to the first side of the material so that the tape is adhered to the first side of the material and covers the central portion of the binder; and a supply means for supplying pre-cut sheets of the material from a supply of sheet, each sheet having the predetermined length.

18. The apparatus as claimed in claim 17, which includes a cutter to cut the tape so that a portion of the tape extends beyond each cut edge of the lengths of material.

19. The apparatus as claimed in claim 18, which includes a folding device for folding each portion of the tape over its associated edge and applying each portion to an opposed side of the material.

* * * * *

UNITED STATES PATENT AND TRADEMARK OFFICE
Certificate

Patent No. 6,190,298 B1 Patented: February 20, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Murray B. Blumberg, Gauteng, South Africa and William M. Hoffman, Hamilton, Ohio.

Signed and Sealed this Twenty-sixth Day of March 2002.

RINALDI RADA
*Supervisory Patent Examiner*
Art Unit 3721